United States Patent [19]

Holznagel

[11] Patent Number: 4,844,100

[45] Date of Patent: Jul. 4, 1989

[54] METHOD OF AND APPARATUS FOR MAKING ROD-SHAPED SMOKERS' ARTICLES WITH DENSE ENDS

[75] Inventor: Uwe Holznagel, Glinde, Fed. Rep. of Germany

[73] Assignee: Körber AG, Hamburg, Fed. Rep. of Germany

[21] Appl. No.: 95,415

[22] Filed: Sep. 10, 1987

[30] Foreign Application Priority Data

Sep. 13, 1986 [DE] Fed. Rep. of Germany ..... 3631227

[51] Int. Cl.[4] ..... A24C 5/18

[52] U.S. Cl. ..... 131/84.1

[58] Field of Search ..... 131/84.1, 84.2, 84.3, 131/84.4, 406

[56] References Cited

U.S. PATENT DOCUMENTS

| | | | |
|---|---|---|---|
| 3,032,041 | 5/1962 | Lanore | 131/84.1 |
| 3,318,314 | 5/1967 | Steizer | 131/84.1 |
| 3,604,430 | 9/1971 | Norwich et al. | 131/84.1 |
| 3,951,267 | 4/1976 | Reuland | 209/73 |
| 4,538,626 | 9/1985 | Hinzmann | 131/84.4 |
| 4,651,755 | 3/1987 | Rudszinat | 131/84.4 |

*Primary Examiner*—V. Millin

*Attorney, Agent, or Firm*—Peter K. Kontler

[57] ABSTRACT

Longitudinally spaced-apart portions of a tobacco stream in a cigarette maker are densified and the stream is then draped into a web of cigarette paper prior to being severed across the densified portions to yield a succession of plain cigarettes each having two dense ends. The characteristics of both ends of some or all of the cigarettes are monitored independently of each other and the resulting signals are totalized and thereupon compared to indicate the extent of deviation of the quality of one dense end from the other dense end. If the deviation exceeds a selected threshold value, the densifying station is shifted nearer to or further away from the severing station so as to eliminate or reduce the differences.

14 Claims, 4 Drawing Sheets

METHOD OF AND APPARATUS FOR MAKING ROD-SHAPED SMOKERS' ARTICLES WITH DENSE ENDS

BACKGROUND OF THE INVENTION

The invention relates to improvements in methods and apparatus for making rod-shaped smokers' articles (such as plain cigarettes or filter cigarettes) with dense ends.

Cigarettes with dense ends are normally produced by forming a continuous stream of fibrous material in a cigarette maker and densifying the stream at uniformly spaced locations prior or during draping of a web of cigarette paper therearound. The thus obtained cigarette rod is then severed across the densified portions and the resulting plain cigarettes are normally tested for the quality of their ends. It is customary to densify both ends of a plain cigarette or to densify the tobacco-containing ends of filter cigarettes so as to reduce the likelihood of escape of tobacco particles at the ends.

As a rule, or at least in many instances, the cigarette rod wherein the filter contains equidistant densified portions is severed midway across each densified portion. This ensures that the thus obtained halves of each densified portion are identical, or at least similar, as regards their length and other characteristics.

In accordance with a prior proposal, attempts to ensure the severing of a cigarette rod midway across the densified portions include accurate synchronization of operation of the trimming device (which removes the surplus from the tobacco stream) with that of the severing device (known as cutoff). Reference may be had to U.S. Pat. No. 3,604,430. The trimming device has one or more rotary disc-shaped surplus removing or trimming members with peripheral pockets which serve to prevent removal of the surplus in the regions of future densified portions of the filler. In order to correct the operation of the machine (if the tests indicate that the density of cigarette ends is unsatisfactory because the cigarette rod is not severed midway across the densified portions of its filler), the angular position of the rotary disc-shaped trimming member or members is changed to thus alter the positions of densified portions with reference to the cutting plane which is defined by the cutoff. The monitoring operation is carried out upon the cigarette rod, i.e., prior to subdivision of the rod into discrete rod-shaped articles of unit length or multiple unit length. This is not entirely satisfactory because additional departures from satisfactory operation can develop between the monitoring station and the cutoff. In other words, the monitoring of densified portions of the stream is premature so that the just discussed method and apparatus cannot invariably ensure that all defects in the making of cigarettes or other rod-shaped smokers' articles with dense ends can be remedied by the expedient of changing the angular position or positions of one or more rotary disc-shaped trimming members.

A further presently known mode of making rod-shaped smokers' articles with dense ends is disclosed in commonly owned copending patent application Ser. No. 899,348 filed Aug. 22, 1986 by Uwe Heitmann for "Apparatus for making cigarettes with dense ends", now U.S. Pat. No. 4,729,386 granted Mar. 8, 1988.

OBJECTS AND SUMMARY OF THE INVENTION

An object of the invention is to provide a novel and improved method of making rod-shaped smokers' articles with dense ends in such a way that the dense ends of the articles exhibit identical characteristics or that the characteristics of dense ends of successively formed articles deviate only negligibly from an optimum value.

Another object of the invention is to provide a novel and improved method of selecting the loci of densification of a mass of fibrous material which is to form the fillers of plain cigarettes or other rod-shaped articles of the tobacco processing industry.

A further object of the invention is to provide a method which renders it possible to rapidly and effectively alter the densifying operation if the characteristics of dense ends on successive rod-shaped articles deviate from optimum characteristics.

An additional object of the invention is to provide a simple and inexpensive method of making dense-end cigarettes with or without filters in available machines with a minimum of modifications.

Still another object of the invention is to provide a novel and improved apparatus which can be used in existing machines or production lines for the making of cigarettes or other rod-shaped articles of the tobacco processing industry to turn out articles with identical or largely identical dense ends.

A further object of the invention is to provide the apparatus with novel and improved means for monitoring the dense ends of rod-shaped articles and with novel and improved means for processing and utilizing the signals which are generated by the monitoring means.

Still another object of the invention is to provide the apparatus with novel and improved means for adjusting the densifying means when the characteristics of some or all of the dense ends deviate from an optimum value.

Another object of the invention is to provide a machine or a production line which embodies the above outlined apparatus.

One feature of the present invention resides in the provision of a method of making rod-shaped smokers' articles, such as plain or filter cigarettes. The method comprises the steps of forming a continuous stream of smokable fibrous material and advancing the stream longitudinally in a predetermined direction along an elongated path, densifying longitudinally and equally spaced-apart portions of the stream at a condensing location in the path, draping the densified stream into a web of wrapping material, severing the draped stream across the densified portions in a predetermined portion of the path so that the draped stream yields a series of rod-shaped articles of identical length each having a fibrous filler with first and second densified end portions, testing at least some of the articles including separately monitoring the characteristics of the first and second end portions of the articles and comparing the monitored characteristics of the first and second end portions of tested articles, and shifting the condensing location with reference to the predetermined portion of the path in the longitudinal direction of the path when the characteristics of the first end portions of tested articles deviate to a predetermined extent from the characteristics of the respective second end portions. The shifting step includes moving the condensing location in a direction to reduce the deviations of the characteristics of the first end portions of tested articles from the characteristics of the respective second end portions.

The monitoring step can include generating first and second signals which respectively denote the characteristics of the first and second end portions of tested articles. The comparing step then includes totalizing a plurality of first signals (e.g., during a selected interval of time) to form a third signal, totalizing the corresponding second signals to form a fourth signal, and comparing the third and fourth signals. The shifting step then includes moving the condensing location in a direction to reduce deviations of the characteristics of the first end portions from the characteristics of the respective second end portions of tested articles when at least one parameter (such as the intensity) of the third signal deviates from the corresponding parameter of the fourth signal to a predetermined extent such as warrants the carrying out of an adjustment.

If the first end portions of the rod-shaped articles which are formed by severing the draped stream are located ahead of the respective second end portions, the shifting step includes respectively moving the condensing location toward and away from the predetermined portion of the path when the intensity of the third signal respectively exceeds and is less pronounced than the intensity of the fourth signal. This ensures that the locus of densification of spaced-apart portions of the stream is shifted in a direction to reduce the differences between the characteristics (e.g., lengths) of the first and second end portions of the articles.

Another feature of the present invention resides in the provision of an apparatus for making rod-shaped smokers' articles, such as plain cigarettes in a cigarette maker. The apparatus comprises means (such as a duct which showers fibrous material against an endless belt conveyor to which the particles are attracted by suction) for forming a continuous stream of smokable fibrous material, means (such as the aforementioned conveyor) for advancing the stream longitudinally in a predetermined direction along an elongated path, means for densifying longitudinally equally spaced-apart portions of the stream at a condensing location in the path, a so-called format or other suitable means for draping the densified stream into a web of wrapping material (e.g., cigarette paper) downstream of the condensing location, a cutoff or other suitable means for severing the draped stream across the densified portions in a predetermined portion of the path so that the stream yields a series of rod-shaped articles each having a fibrous filler with first and second densified end portions, and testing means including means for separately monitoring the characteristics of the first and second end portions of at least some of the rod-shaped articles and for generating first and second signals which respectively denote the monitored characteristics of the first and second end portions of tested articles. The testing means further comprises means for processing the signals including means for directly or indirectly comparing the first and second signals, and the apparatus further comprises means for shifting the densifying means longitudinally of the path in response to the signals when the characteristics of the second end portions deviate from the characteristics of the first end portions to a predetermined extent.

The comparing means can comprise means for generating additional signals which are indicative of the differences of characteristics of the first and second end portions of tested articles, and the shifting means includes means for moving the densifying means in a direction to reduce such differences.

In accordance with a presently preferred embodiment of the apparatus, the testing means further includes a source of reference signals denoting acceptable characteristics of the end portions of rod-shaped articles, and the comparing means of such testing means comprises means for comparing the first and second signals with the reference signal. The processing means of such testing means further comprises means (e.g., suitable counters) for separately totalizing the numbers of first and second signals which deviate from the reference signal and for generating third and fourth signals which respectively denote the totalized first and second signals. Still further, the testing means comprises means for comparing the third and fourth signals and for generating additional (fifth) signals denoting the differences between the third and fourth signals, and the shifting means is then responsive to the additional signals.

The testing means can be installed in a machine which follows the maker, e.g., in a filter tipping machine, and can include means for transporting the tested articles transversely of their respective axes (i.e., sideways) past the monitoring means. For example, the transporting means can include a substantially drum-shaped conveyor forming part of a filter tipping machine.

In accordance with a presently preferred embodiment of the apparatus, the testing means includes a capacitive testing unit for at least one end portion of each tested rod-shaped article.

The forming means includes means for making a stream which contains a surplus, i.e., which contains fibrous material in excess of that in the fillers of rod-shaped articles. The apparatus which embodies such forming means includes means for removing the excess from the stream intermediate the densifying means (condensing location) and the predetermined portion of the path, and the densifying means of such apparatus can comprise means for compacting the equally spaced-apart portions of the stream so that the excessive removing means removes less fibrous material from compacted portions of the stream. The compacting means can comprise a rotor and means for intermittently moving the rotor transversely of the path.

Alternatively, the densifying means can include the means for removing the excess from the stream, at least in the regions between the spaced-apart portions of the stream. Such excess removing means can comprise at least one rotary cutter having a peripheral portion provided with pockets for fibrous material and with cutting or clamping edges which alternate with the pockets. Actual (or at least some) densification of spaced-apart portions of the stream then takes place in the course of the draping step.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
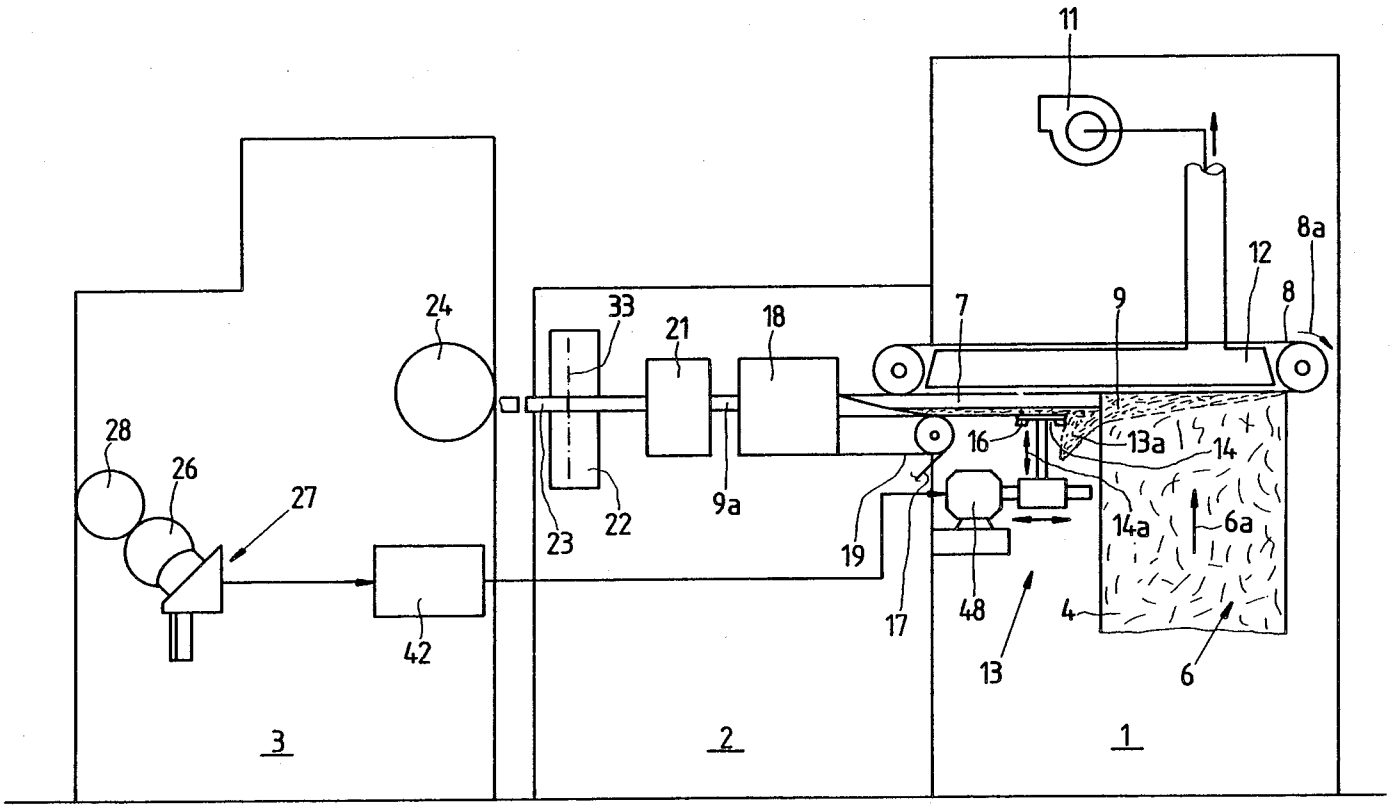
FIG. 1 is a schematic partly elevational and partly sectional view of an apparatus which embodies one form of the invention.

FIG. 1 shows schematically a cigarette maker which cooperates with a filter tipping machine 3. The maker comprises a tobacco stream forming assembly 1 and a cigarette making assembly 2; the latter delivers rod-shaped smokers' articles in the form of plain cigarettes 23 of double unit length to the filter tipping machine 3. The illustrated maker can be of the type known as PROTOS which is manufactured and distributed by the assignee of the present application; its stream forming assembly 1 is known as VE 80 and its cigarette making assembly 2 is known as SE 80. The machine 3 can be of the type known as MAX 80 (manufactured and distributed by the assignee of the present application).

The stream forming assembly 1 includes a stream forming device including an upwardly extending duct 4 which delivers a shower of fibrous material 6 (such as particles of reconstituted tobacco, particles of substitute tobacco and/or particles of natural tobacco leaves) in the direction of arrow 6*a* so that the particles gather at the underside of the lower reach of an endless foraminous belt conveyor 8 and form a stream 9 which contains a surplus of excess 13*a* of tobacco, namely more than required for the fillers of discrete plain cigarettes 23 of double unit length. The exact construction of the means for supplying fibrous material which forms the shower 6 is no part of the invention; reference may be had to numerous United States Letters Patent which are owned by the assignee of the present application and show suitable distributors (also called hoppers) serving to draw fibrous material from a magazine and to convert the withdrawn material into a shower which is ready to be converted into a continuous stream containing a surplus of fibrous material. The lower reach of the conveyor 8 is adjacent the open underside of a stationary suction chamber 12 which draws the particles of the shower 6 against the underside of the lower reach of the conveyor 8 and compels the resulting stream 9 to advance in a predetermined direction (to the left) along a predetermined path toward a draping device 18, e.g., a so-called format wherein the stream 9 is draped into a web 17 of cigarette paper or other suitable wrapping material to form therewith a continuous cigarette rod 9*a*. A portion of the elongated path is defined by a tobacco channel 7 which is adjacent the underside of the lower reach of the conveyor 8. The latter is trained over several pulleys and is driven to advance in the direction of arrow 8*a*. The reference character 11 denotes a fan or another suitable suction generating device which is connected with the outlet of the suction chamber 12.

Figure 5:
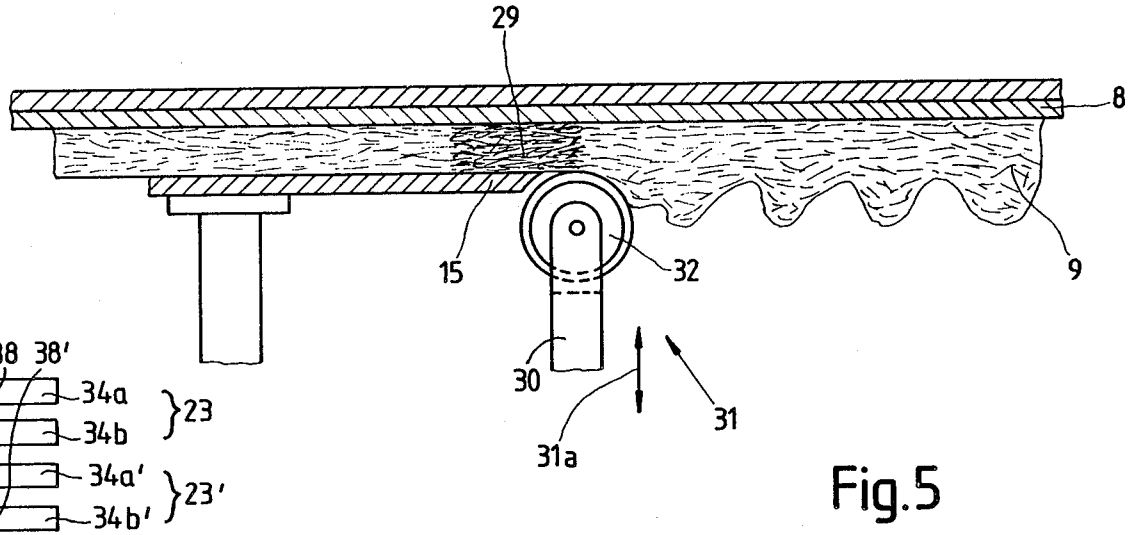
FIG. 5 is a fragmentary partly elevational and partly sectional view of a modified apparatus wherein the densifying means includes a rotor which is movable at intervals transversely of the path of movement of the stream.

The fully grown stream 9 (which contains a surplus 13*a* of fibrous material (such surplus can form hills and valleys as shown in the right-hand portion of FIG. 5) is advanced past a densifying or condensing location 13 which is shiftable in the longitudinal direction of the channel 7 and accommodates a combined densifying and excess removing device having one or more rotary disc-shaped excess removing and stream densifying trimming members 14 with peripheral pockets 16 which alternate with tobacco cutting or clamping edges. The pockets 16 temporarily receive the surplus which should not be removed from the stream 9; the remaining surplus 13*a* is removed by the cutting or clamping edges of the device or devices 14 in cooperation with a rotary cutting tool in a manner well known from the art. Reference may be had to commonly owned U.S. Pat. No. 4,538,626 granted Sept. 3, 1985 to Hinzmann and to commonly owned U.S. Pat. No. 4,651,755 granted Mar. 24, 1987 to Rudszinat. Each of these patents shows a surplus removing device with two rotary disc-shaped trimming members and a tool serving to brush or cut off the excess extending downwardly beyond the common plane of the trimming members. Actual densification of longitudinally spaced-apart equidistant portions 29 (FIG. 2A) of the stream 9 takes place during travel of such portions through the draping device 18 wherein the surplus which was not removed, due to the fact that it was received in the pockets 16 of the rotary disc-shaped trimming member or members 13 during travel at the condensing location 13, is compacted because the device 18 converts the trimmed stream 9 into a rod-like filler whose diameter is constant. The quantity of fibrous material per unit length of the trimmed stream can be regulated by moving the device including the trimming member or members 14 up or down as indicated by a double-headed arrow 14*a* and as is well known from the art of cigarette rod making machines.

Successive increments of the trimmed stream 9 are transferred onto the upper reach of an endless belt conveyor 19 which is known as garniture and serves to transport the stream and the web 17 of cigarette paper through the draping device 18 so as to form the cigarette rod 9*a*. The web 17 is drawn off a bobbin, not shown, or from another suitable source and is converted into a tube with overlapping marginal portions which are bonded to each other by an adhesive to confine the filler of the rod 9*a*. Successive increments of the rod 9*a* pass through a density measuring device 21 (e.g., a device which employs a source of corpuscular radiation) serving to adjust (arrow 14*a*) the level of the device including the trimming member or members 14. The rod 9*a* is severed at regular intervals in a cutoff 22 which is located downstream of the density measuring device 21 and has one or more orbiting knives (not shown) serving to sever the rod 9a in a predetermined portion (denoted by the phantom line 33) of its path. The cutoff 22 subdivides the rod 9a into a file of discrete plain cigarettes 23 of double unit length, and each such cigarette has two densified end portions (34a, 34b in FIGS. 2A and 2B) because the rod 9a is severed across those portions 29 of the stream 9 which were densified as a result of confinement of some of the fibrous material in the pockets 16 of the rotary disc-shaped trimming member or members 14 and subsequent travel of such material through the draping device 18.

Successive plain cigarettes 23 of double unit length which advance beyond the cutoff 22 are caused to change the direction of their travel so that they move sideways (at right angles to their respective axes) and enter the axially parallel peripheral flutes of a drum-shaped conveyor 24 in the filter tipping machine 3. The mechanism which changes the direction of movement of plain cigarettes from axial to sidewise movement is a standard part of each PROTOS machine. The machine 3 converts each plain cigarette 23 of double unit length and a filter rod section 37a+38a (see FIGS. 2B and 2C) into a filter cigarette of double unit length by cutting each cigarette 23 midway between its ends, by inserting the respective filter rod section 37a+38a between the thus obtained plain cigarettes 37, 38 of unit length, and by draping a web of tipping paper around the filter mouthpiece and the adjacent end portions of plain cigarettes of unit length. Each filter cigarette of double unit length has two dense end portions 34a, 34b which are remote from the filter rod section of double unit length and each of which is supposed to contain one-half (36) of a densified portion 29.

Filter cigarettes of double unit length are subjected to several tests in testing units which are installed in the filter tipping machine 3. The latter includes a conveyor 26 (e.g., a rotary drum) which transports the filter cigarettes of double unit length at right angles to their respective axes through one or more testing stations defined by one or more testing devices. The filter cigarettes can be tested to ascertain the presence or absence of holes, frayed ends, open seams, fragments of tobacco particles adhering to the external surfaces of their wrappers or uniting bands, the presence or absence of one or both plain cigarettes of unit length, the presence or absence of the filter rod section of double unit length, and/or other potential defects. All such testing techniques are well known in the art and need not be described here.

In accordance with the invention, each of the filter cigarette of double unit length or each filter cigarette of unit length is further tested to ascertain the condition or characteristics of the densified end portions 34a, 34b of the respective plain cigarettes 37, 38 of unit length. Such testing or monitoring can be carried out in a testing device in a manner as shown in FIGS. 2B and 2C or in FIG. 4. Tested filter cigarettes of double unit length are accepted by a further drum-shaped rotary conveyor, such as the conveyor 28 of FIG. 1, which transports them to a severing or subdividing station so that the resulting filter cigarettes of unit length are ready for transport to storage, to a packing machine or to another destination.

Figure 2A:
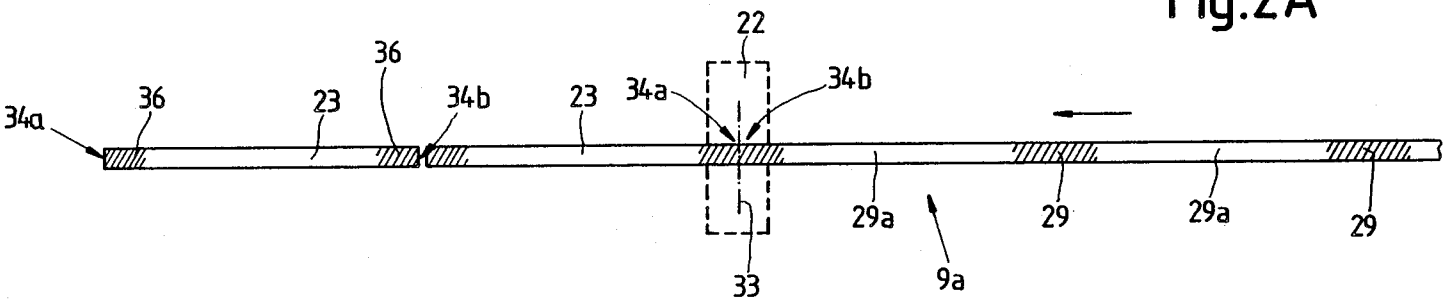
FIG. 2A is an enlarged elevational view of the stream and of its spaced-apart densified portions, the severing means being indicated by broken lines and the cutting plane being indicated by a phantom line.
Figure 2B:
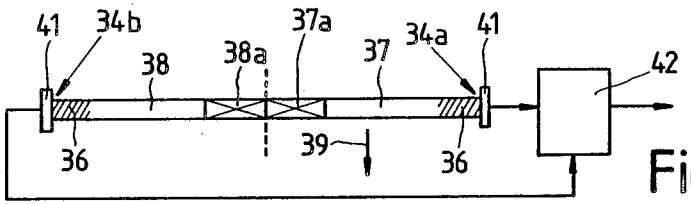
FIG. 2B shows a satisfactory rod-shaped article (upon conversion into a portion of a filter cigarette of double unit length) at the testing station.
Figure 2C:
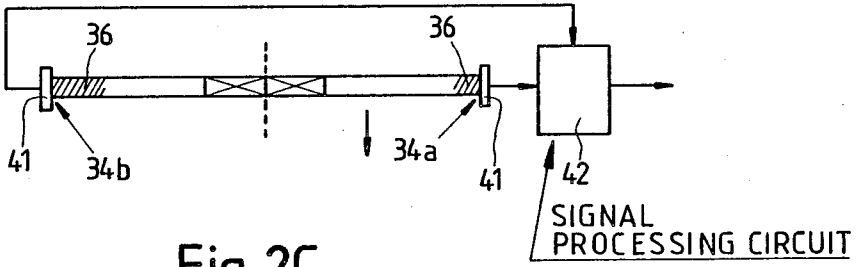
FIG. 2C shows a defective rod-shaped article at the testing station.

FIG. 2A shows a portion of the continuous cigarette rod 9a which contains a filler of intermittently densified fibrous material and the aforementioned tube or envelope consisting of the converted cigarette paper web 17. The equidistant densified portions of the filler of the rod 9a are shown at 29. Each such portion is formed as a result of the pockets 16 leaving some excess of fibrous material during travel of the corresponding portions of the stream 9 through the densifying location 13 and as a result of subsequent compacting of the surplus or excess in the draping device 18. The densified portions 29 alternate with undensified or less densified portions 29a of the filler of the rod 9a. Such mode of densifying longitudinally spaced-apart portions of a stream of fibrous material is disclosed in the aforementioned patents to Hinzmann and Rudszinat as well as in U.S. Pat. No. 3,032,041.

FIG. 2A further shows the cutoff 22 and the predetermined portion 33 of the path wherein the cutoff severs the advancing cigarette rod 9a at regular intervals to form a file of plain cigarettes 23 of double unit length. It is desirable to select the distance of the condensing location 13 from the predetermined portion 33 of the path in such a way that the rod 9a is severed midway across the densified portions 29 of its filler so that each densified portion yields two mirror symmetrical densified end portions 34a, 34b each containing one-half (36) of the mass of densified fibrous material which forms a portion 29. The purpose of monitoring of the leading and trailing end portions 34a, 34b of plain cigarettes 23 (in the embodiment of FIGS. 1 and 4 subsequent to subdivision of each such plain cigarette into two plain cigarettes 37, 38 of unit length) is to ascertain the condition of such end portions and to undertake a remedial action if the characteristics of the leading end portion 34a deviate from the characteristics of the associated or related trailing end portion 34b to an extent which warrants an adjustment. Such adjustment involves a shifting of the densifying or compacting or condensing location 13 toward or away from the predetermined portion 33 in the longitudinal direction of the path of advancement of the stream 9 and cigarette rod 9a. the associated or related end portions 34a, 34b are actually formed in the course of two successive severing operations, i.e., each severing step involves the making of a densified end portion 34b at the trailing end of the freshly formed plain cigarette 23 of double unit length and the making of a densified end portion 34a behind the predetermined portion 33; the end portion 34a constitutes the leading or front end portion of the next plain cigarette 23 of double unit length.

If the operation of the trimming device including the rotary disc-shaped trimming member or members 14 is properly synchronized with the operation of the cutoff 22, each densified portion 29 is severed exactly or practically exactly midway between its ends to yield two mirror symmetrical end portions 34a, 34b. Thus, of one monitors the condition or characteristics of the end portions 34a and 34b on some or all of the plain cigarettes 23 of double unit length (or on the corresponding pairs of plain cigarettes 37, 38 of unit length), signals which are generated in the course of such monitoring operation can be processed and used to shift the device including the trimming member or members 14 toward or away from the predetermined portion 33 in order to correct the operation of the maker if the testing operation reveals that the characteristics of the end portion 34a deviate from the characteristics of the corresponding end portion 34b to an extent which warrants a shifting of the compacting location 13 so as to reduce or eliminate the differences between such characteristics.

Figure 3:
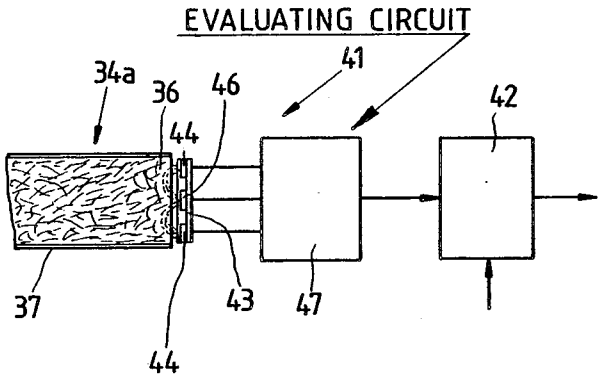
FIG. 3 is an enlarged elevational view of a capacitive testing unit for one end portion of a rod-shaped article.

FIG. 2B shows a filter cigarette of double unit length in the testing unit of the filter tipping machine 3. The conveyor 26 transports the filter cigarette at right angles to its longitudinal axis as indicated by the arrow 39. The testing device comprises two capacitive testing units 41 which flank the path of movement of the filter cigarette of double unit length and each of which can be designed in a manner as shown in FIG. 3. These testing units 41 transmit signals to a signal processing circuit 42 which constitutes a slight modification of the circuit shown in FIG. 4. Capacitive testing units which can be used in the testing means of the improved apparatus are disclosed, for example, in U.S. Pat. No. 3,951,267. The testing unit 41 of FIG. 3 comprises a capacitor 43 with an annular electrode or plate 44 surrounding a centrally located electrode or plate 46. These electrodes are adjacent the path of movement of the end portion 34*a* or 34*b* of the respective plain cigarette 37 or 38 during movement of the corresponding filter cigarette of double unit length through the testing station. The reference character 47 denotes in FIG. 3 a circuit which includes a source of high-frequency current and an evaluating circuit. The output of the circuit 47 (whose design is conventional) is connected with the corresponding input of the signal processing circuit 42.

In FIG. 2B, the characteristics of the end portion 34*b* are identical or practically identical with the characteristics of the end portion 34*a*. Consequently, the two testing units 41 transmit identical or practically identical signals which are processed and evaluated in a manner similar to that to be described with reference to FIG. 4 and do not cause any adjustment of the compacting location 13 in a direction toward or away from the predetermined portion 33 of the path.

FIG. 2C shows a filter cigarette of double unit length wherein the densified end portion 34*b* of the left-hand plain cigarette is considerably longer than the densified end portion 34*a* of the right-hand plain cigarette. This is indicative of a defective operation of the cigarette maker including the assemblies 1 and 2, namely the compacting location 13 is too remote from the predetermined portion 33 (the leading end portion 34*a* is shorter than the trailing end portion 34*b*) so that the circuit 42 then generates a signal which is or can be used to start a motor 48 constituting a means for shifting the device including the trimming member or members 14 toward the predetermined portion 33.

An important advantage of the just described mode of adjusting the position of the compacting location 13 relative to the predetermined portion 33 is that the monitoring is carried out in the filter tipping machine 3, i.e., downstream of the locus of the making of plain cigarettes 23 of double unit length so that the dimensions of the end portions 34*a*, 34*b* at the testing station are final and cannot be altered in the course of next-following treatment of filter cigarettes of double unit length. Consequently, testing at the station including the testing means 27 of FIG. 1 ensures that all sources of potential defects are located upstream of the testing location.

FIGS. 2A and 2B show one presently preferred mode of testing associated or related end portions 34*a*, 34*b* of successive plain cigarettes 23 of double unit length, namely in a simultaneous operation. However, it is equally possible to test the end portions 34*a* and 34*b* subsequent to the making of filter cigarettes of unit length. As a rule, two neighboring filter cigarettes of unit length then contain the two halves (37, 38) of a plain cigarette 23 of double unit length and the filter mouthpieces of all filter cigarettes of unit length face in the same direction. The testing operation is then carried out in such a way that the signal which is generated on testing of a given filter cigarette of unit length is compared with the signal which is generated on testing of the immediately following filter cigarette of unit length to thus ensure that the signals can be properly compared with each other in order to ascertain whether or not the characteristics of end portions 34*a*, 34*b* which are obtained from one and the same plain cigarette 23 of double unit length are identical or deviate sufficiently to warrant an adjustment of the distance of the compacting location 13 from the predetermined portion 33. This can be seen in FIG. 6 which shows a series of six parallel filter cigarettes of unit length. The two topmost filter cigarettes are obtained from the filter cigarette of double unit length which is shown in FIGS. 2B or 2C. The next two filter cigarettes of unit length are obtained from the next filter cigarette of double unit length and their parts are denoted by reference characters corresponding to those shown in FIG. 2B or 2C but each followed by a prime. The two lowermost filter cigarettes of unit length are obtained as a result of severing of a third filter cigarette of double unit length, and their parts are denoted by characters resembling those used in FIG. 2B or 2C but each followed by two primes. The signal processing circuit which is used in connection with the testing of filter cigarettes of unit length is designed to compare signals which are generated on monitoring of the end portions 34*a*, 34*b*, to thereupon compare signals which are obtained on monitoring of the end portions 34*a*', 34*b*', to thereupon compare signals which are generated in response to monitoring of the end portions 34*a*'', 34*b*'', and so forth.

Filter tipping machines of the aforedescribed type are provided with turn-around devices which turn one filter cigarette of unit length of each pair of cigarettes which are obtained as a result of severing a filter cigarette of double unit length so that all of the filter mouthpieces 27*a*, 38*a*, 37*a*', 38*a*' and so forth face in the same direction.

Figures 4, 4A:
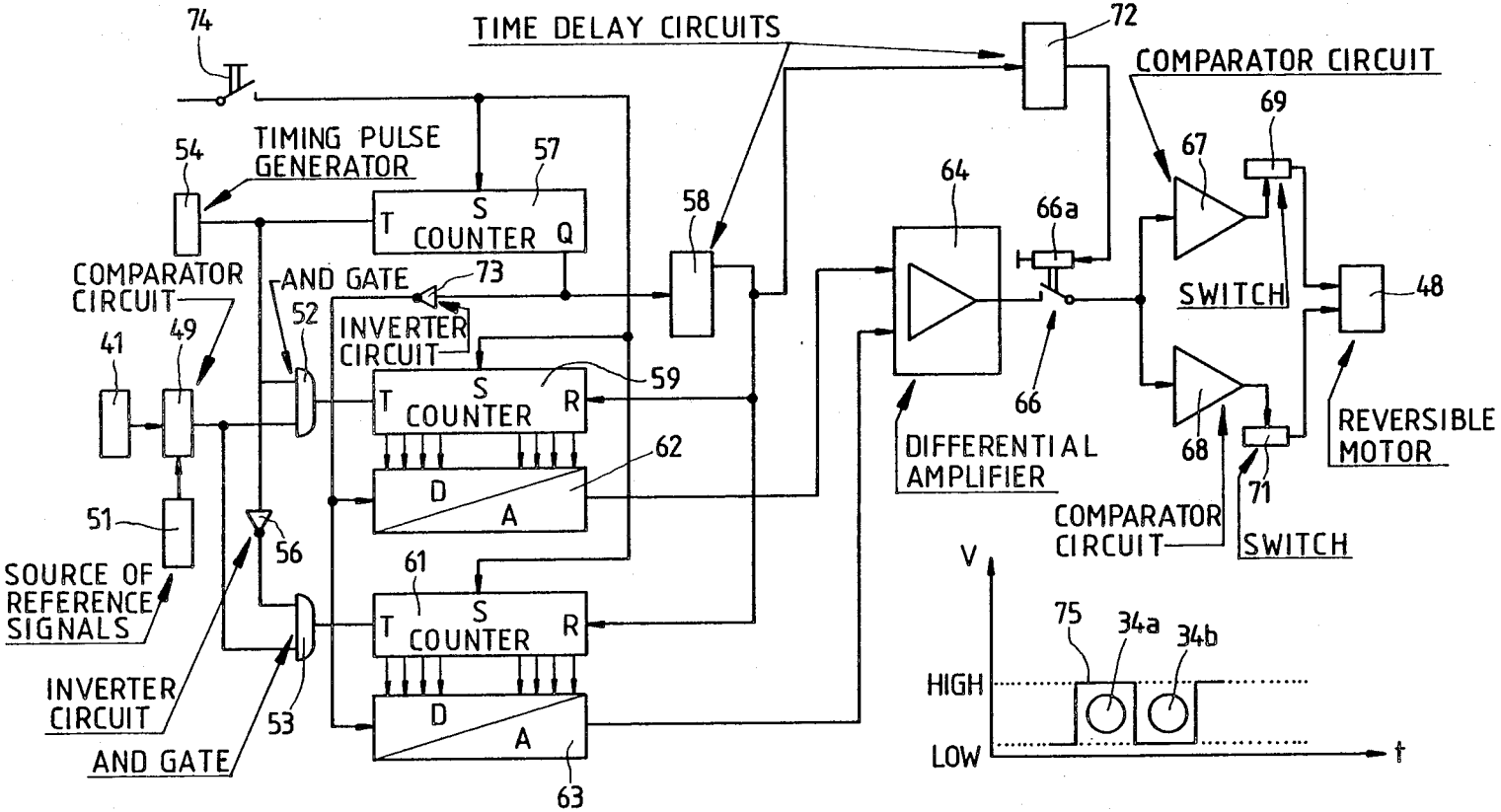
FIG. 4 is a block diagram of a testing means which can be used in the apparatus of FIG. 1.
FIG. 4A is a diagram showing the signals which are generated by a pulse generator in the testing means of FIG. 4.
Figure 6:
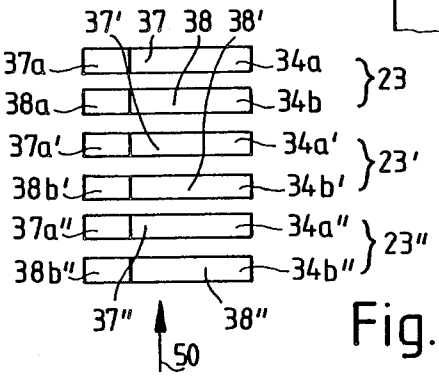
FIG. 6 shows a distribution of rod-shaped articles which is required for testing in the apparatus including the testing means of FIG. 4.

The signal processing circuit 42 which is shown in FIGS. 1 and 4 is designed to monitor the end portions 34*a*, 34*b*, 34*a*' . . . of filter cigarettes of unit length which advance in the direction of arrow 50 of FIG. 6, i.e., at right angles to their respective axes. An advantage of such testing means is that it can operate with a single capacitive testing unit 41 which transmits signals denoting the densities and/or lengths of successive end portions 34*a*, 34*b*, 34*a*' . . . to a comparator circuit 49 which receives a reference signal from a suitable source 51, e.g., an adjustable potentiometer or the like.

The output of the comparator circuit 49 is connected with the corresponding inputs of two AND gates 52 and 53. The other input of the AND gate 52 is connected with the output of a timing pulse generator 54 serving to generate pulses at a frequency corresponding to that of advancement of successive filter cigarettes of unit length past the testing unit 41. The output of the timing pulse generator 54 is connected with the other input of the AND gate 53 by an inverter circuit 56. Still further, the output of the timing pulse generator 54 is connected with the counting input T of a pulse counter 57 having an output Q connected with a time-delay circuit 58 which, in turn, is connected with the resetting inputs of two signal counters 59 and 61. The counting input T of the first signal counter 59 is connected with the output of the AND gate 52, and the counting input T of the second signal counter 61 is connected with the output of the AND gate 53. The counters 59, 61 are respectively connected with the digital-analog converters 62, 63 whose outputs are connected with the corresponding inputs of a second comparator circuit in the form of a differential amplifier 64. The output of the differential amplifier 64 is connectable, by way of a switch 66, with a regulating means including two comparator circuits 67, 68 each of which can start the motor of the shifting means 48 in a different direction in response to closing of the associated switch 69, 71. The switches 69, 71 serve to connect the control circuit for the motor of the shifting means 48 to an energy source of requisite polarity so that one of these switches can initiate a movement of the condensing location 13 toward and the other switch can initiate a movement of the location 13 away from the predetermined portion 33. The switch 66 can be closed by an actuator 66*a* which is connected with the output of the time-delay circuit 58 by way of a second time-delay circuit 72.

The output Q of the pulse counter 57 is further connected with the digital-analog converters 62, 63 by way of an inverter circuit 73. A master switch 74 must be closed to energize the circuit 42, i.e., to set the counters 57, 59 and 61 at S.

The operation of the signal processing circuit of FIG. 4 is as follows:

As mentioned above, the apparatus which embodies the circuit 42 is assumed to test the end portions of filter cigarettes of unit length which are advanced toward, through and beyond the testing station in the form of a single row and in the direction of arrow 50 as shown in FIG. 6. Thus, the filter tips 37*a*, 38*a*, 37' . . . of all filter cigarettes face in the same direction, and this also holds true for the densified end portions 34*a*, 34*b*, 34*a* . . . of these filter cigarettes. The end portions 34*a*, 34*b* are related in that they form part of two plain cigarettes 37, 38 which were obtained from a given plain cigarette 23 of double unit length, the same as the end portions 34*a*', 34*b*' and 34*a*'', 34*b*'' as well as the end portions of next-following pairs of neighboring filter cigarettes of unit length.

Signals which are generated by the capacitive testing unit 41 are compared at 49 with the reference signal which is furnished by the source 51. If the intensity or another characteristic of the signal from 41 deviates from the reference signal, the comparator circuit 49 transmits a defect signal which is applied to the corresponding inputs of the AND gates 52 and 53. At the same time, the timing pulse generator 54 transmits square wave pulses 75 (note FIG. 4A) whose timing is selected in such a way that the corresponding input of the AND gate 52 and the inverter circuit 56 receive a "high" pulse during testing of end portions 34*a*, 34*a*', 34*a*'' . . . and a "low" signal during testing of end portions 34*b*, 34*b*', 34*b*'' . . . Thus, when the testing unit 41 monitors one or more parameters of the end portion 34*a*, one input of the AND gate 52 receives a signal from the comparator circuit 49 and the other input of this gate receives a "high" signal from the timing pulse generator 54. At the same time, the inverter circuit 56 applies a "low" signal to the corresponding input of the AND gate 53 (the other input of this gate receives a signal from the comparator circuit 49). If the signal from the comparator circuit 49 is a defect signal (i.e., a "high" signal, the output of the AND gate 52 transmits a signal to the input T of the signal counter 59. The gate 53 does not transmit a signal to the signal counter 61 because one of its inputs receives a "low" signal from the inverter circuit 56.

When the testing unit 4 thereupon monitors the end portion 34*b*, the timing pulse generator 54 transmits a "low" signal and, therefore, the output of the AND gate 52 cannot transmit a signal to the signal counter 59 even if the signal at the output of the comparator circuit 49 is a defect ("high") signal because the signals at the two inputs of the AND gate are not identical. However, and if the signal which is generated by the unit 41 during testing of the end portion 34*b* is a defect ("high") signal, the output of the AND gate 53 transmits a signal to the input T of the signal counter 61 because such defect signal is received by the gate 53 simultaneously with a "high" signal from the inverter circuit 56 (as mentioned above, the timing pulse generator 54 then transmits a "low" signal which is inverted at 56). It will be seen that, as the testing operation progresses, the signal counter 59 stores information pertaining to the number of defective (first or leading) end portions 34*a*, 34*a*' . . . while the signal counter 61 stores information pertaining to the number of defective (second or trailing) end portions 34*b*, 34*b*' . . . The digital/analog converter circuits 62, 63 respectively convert the information which is stored by the signal counters 59, 61 into analog (third and fourth) signals which are continuously compared with each other in the differential amplifier 64. The (fifth) signal at the output of the differential amplifier 64 is indicative of the differences between the sum of parameters of first or leading end portions and the sum of parameters of the second or trailing end portions of the rod-shaped articles 23. After elapse of a preselected interval which is determined by the counter 57 (namely when the counter 57 receives a preselected number of pulses from the timing pulse generator 54), the actuator 66*a* for the switch 66 is operated by way of the time-delay circuits 58 and 72 so that the switch 66 is closed and the output of the differential circuit 64 is addressed by the comparator circuits 67, 68. The delays which are caused by the circuits 58 and 72 are selected in such a way that the signal processing and evaluating operations which are carried out by the signal counters 59, 61 and by the converter circuits 62, 63 as well as in the differential amplifier 64 are completed and the desired (fifth) signal is available at the output of the amplifier 64 when the switch 66 is closed. At the same time, the time-delay circuit 58 transmits a signal to the resetting inputs R of the signal counters 59, 61 upon completed transfer of the stored information to the respective digital/analog converter circuits 62, 63.

Depending on the polarity of the signal which is transmitted by the output of the differential amplifier 64, the comparator circuit 67 or 68 closes the corresponding switch 69, 71 for an interval of time which is required to shift the condensing location 13 in a direction toward or away from the predetermined portion 33 so as to reduce or eliminate the differences between the qualities of the first and second end portions of rod-shaped articles 23 during the next stage of operation of the cigarette maker. Each of the switches 69, 71 can include or constitute a relay which supplies the reversible motor of the shifting means 48 with voltage of requisite polarity in order to effect an appropriate adjustment of the distance of the compacting location 13 from the predetermined portion 33.

A different mode of densifying a continuous stream 9 which contains a surplus or excess of fibrous material is shown in FIG. 5. The underside of the lower reach of the foraminous conveyor 8 attracts the stream 9 during travel past a rotor 32 (e.g., a roller) at the upper end of a bifurcated arm 30 forming part of a densifying or compacting device 31 which is driven by a non-illustrated motor to move up and down as indicated by a double-headed arrow 31*a* and to periodically condense the stream 9 just ahead of a trimming or surplus removing device 15 which is also movable up and down in directions indicated by the arrow 31*a*. The cutting edge of the trimming device 15 removes less fibrous material from the freshly densified portions 29 of the stream 9 so that the latter is converted into a trimmed or equalized stream containing longitudinally spaced-apart equidistant densified portions 29 alternating with non-densified or less densified portions 29*a*, the same as shown in FIG. 2A. The trimming device 15 can be similar to that shown in the patent to Hinzmann or Rudszinat except that its rotary disc-shaped trimming member or members need not be provided with pockets 16. A densifying device which can be used in the apparatus of FIG. 5 is disclosed in U.S. Pat. No. 3,318,314. The rotor 32 of FIG. 5 can be replaced with a roller having one or more lobes; when the stream 9 is in motion and the roller is rotated by the stream or by its own drive, the lobe or lobes densify longitudinally spaced-apart portions of the stream so that the roller need not be moved transversely of the direction of advancement of the stream.

An advantage of the improved method and apparatus is that the densified end portions of the rod-shaped articles are monitored downstream of the severing location. This ensures that no shifting of densified portions with reference to the predetermined portion 33 can take place upon completion of the monitoring operation by the testing unit or units 41 or by other suitable testing means. Moreover, the testing of associated end portions in a simultaneous operation or immediately following one another ensures that the results of tests upon both end portions of each rod-shaped article 23 can be compared in a simple and reliable manner. The results of the testing operation are truly indicative of the positions of successively formed densified portions 29 with reference to the cutting or severing plane in 33 because the monitoring takes place in the maker downstream of the cutoff or in a machine which receives rod-shaped articles from the maker.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making rod-shaped smokers' articles, comprising the steps of forming a continuous stream of smokable fibrous material and advancing the stream longitudinally in a predetermined direction along an elongated path; densifying longitudinally spaced-apart portions of the stream at a condensing location in said path; draping the densified stream into a web of wrapping material; severing the draped stream across the densified portions in a predetermined portion of said path so that the draped stream yields a series of rod-shaped articles each having a fibrous filler with first and second densified end portions; testing at least some of the articles including separately monitoring the characteristics of the first and second end portions of the articles and comparing the monitored characteristics of the first and second end portions of tested articles; and shifting the condensing location with reference to said predetermined portion in the longitudinal direction of the path when the characteristics of the first end portions of tested articles deviate to a predetermined extent from the characteristics of the respective second end portions.

2. The method of claim 1, wherein said shifting step includes moving the condensing location in a direction to reduce the deviations of the characteristics of the first end portions of articles from characteristics of the respective second end portions.

3. The method of claim 1, wherein said monitoring step includes generating first and second signals denoting the characteristics of the first and second end portions of tested articles, said comparing step including totalizing a plurality of first signals to form a third signal, totalizing the corresponding second signals to form a fourth signal, and comparing the third and fourth signals, said shifting step including moving the condensing location in a direction to reduce deviations of the characteristics of the first end portions from the characteristics of the respective second end portions when at least one parameter of the third signal deviates from the corresponding parameter of the fourth signal to a predetermined extent.

4. The method of claim 3, wherein the first end portions of the articles downstream of said predetermined portion of the elongated path are located ahead of the respective second end portions and said shifting step includes respectively moving the condensing location toward and away from said predetermined portion of the path when the intensity of said third signal respectively exceeds and is less pronounced than the intensity of said fourth signal.

5. Apparatus for making rod-shaped smokers' articles, comprising means for forming a continuous stream of smokable fibrous material; means for advancing the stream longitudinally in a predetermined direction along an elongated path; means for densifying longitudinally spaced-apart portions of the stream at a condensing location in said path; means for draping the densified stream into a web of wrapping material downstream of said location; means for severing the draped stream across the densified portions in a predetermined portion of said path so that the stream yields a series of rod-shaped articles each having a fibrous filler with first and second densified end portions; testing means including means for separately monitoring the characteristics of the first and second end portions of at least some of the articles and for generating first and second signals respectively denoting the monitored characteristics of the first and second end portions, and means for processing said signals including means for comparing the first and second signals; and means for shifting said densifying means longitudinally of said path in response to said signals when the characteristics of the second end portions deviate from the characteristics of the respective first end portions of tested articles to a predetermined extent.

6. The apparatus of claim 5, wherein said comparing means includes means for generating additional signals which are indicative of the differences of the characteristics of said first and second end portions of tested articles, said shifting means including means for moving said densifying means in a direction to reduce said differences.

7. The apparatus of claim 5, wherein said testing means further includes a source of reference signals denoting the acceptable characteristics of the end portions of rod-shaped articles and said comparing means includes means for comparing the first and second signals with said reference signal, said processing means further comprising means for separately totalizing the numbers of first and second signals which deviate from said reference signal and for generating third and fourth signals respectively denoting the totalized first and second signals, and means for comparing said third and fourth signals and for generating fifth signals denoting the differences between said third and fourth signals, said shifting means being responsive to said fifth signals.

8. The apparatus of claim 5, wherein said testing means comprises means for transporting the tested articles transversely of their respective axes past said monitoring means.

9. The apparatus of claim 8, further comprising a cigarette maker, said transporting means forming part of said maker.

10. The apparatus of claim 5, wherein said monitoring means comprises a capacitive testing unit for at least one end portion of each tested article.

11. The apparatus of claim 5, wherein said forming means includes means for forming a stream which contains fibrous material in excess of that in the fillers of rod-shaped articles and further comprising means for removing the excess from the stream intermediate said densifying means and said predetermined portion of the path, said densifying means comprising means for compacting said spaced-apart portions of the stream so that the excess removing means removes less fibrous material from the compacted portions of the stream.

12. The apparatus of claim 11, wherein said compacting means including a rotor and means for intermittently moving said rotor transversely of said path.

13. The apparatus of claim 5, wherein said forming means includes means for forming a stream which contains fibrous material in excess of that in the fillers of rod-shaped articles, said densifying means including means for removing the excess from the stream, at least in regions between said spaced-apart portions of the stream.

14. The apparatus of claim 13, wherein said excess removing means comprises at least one rotary cutter having a peripheral portion provided with pockets for fibrous material and clamping portions alternating with said pockets.

* * * * *